US007552997B2

(12) United States Patent
Suzuki et al.

(10) Patent No.: US 7,552,997 B2
(45) Date of Patent: Jun. 30, 2009

(54) INK CARTRIDGE

(75) Inventors: Toru Suzuki, Kanagawa-ken (JP); Junji Shimoda, Kanagawa-ken (JP); Akira Tsujimoto, Kanagawa-ken (JP); Kiyomitsu Kudo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 202 days.

(21) Appl. No.: 10/513,477

(22) PCT Filed: Apr. 23, 2004

(86) PCT No.: PCT/JP2004/005893

§ 371 (c)(1),
(2), (4) Date: Jun. 17, 2005

(87) PCT Pub. No.: WO2004/096559

PCT Pub. Date: Nov. 11, 2004

(65) Prior Publication Data

US 2005/0231572 A1 Oct. 20, 2005

(30) Foreign Application Priority Data

Apr. 25, 2003 (JP) ..... 2003-122005

(51) Int. Cl.
*B41J 2/14* (2006.01)

(52) U.S. Cl. ..... 347/49

(58) Field of Classification Search ..... 347/84, 347/85, 86, 87, 49
See application file for complete search history.

(56) References Cited

U.S. PATENT DOCUMENTS

| | | | | |
|---|---|---|---|---|
| 4,551,735 | A | 11/1985 | Suzuki et al. | 346/140 R |
| 4,734,719 | A | 3/1988 | Suzuki | 346/140 R |
| 4,847,637 | A | 7/1989 | Watanabe et al. | 346/140 R |
| 4,855,762 | A | 8/1989 | Suzuki | 346/140 R |
| 4,980,699 | A | 12/1990 | Tanabe et al. | 346/1.1 |
| 5,359,357 | A * | 10/1994 | Takagi et al. | 347/49 |
| 5,479,193 | A | 12/1995 | Shimoda et al. | 347/7 |
| 5,504,512 | A | 4/1996 | Shimoda et al. | 347/86 |
| 5,552,815 | A | 9/1996 | Shimoda | 347/85 |
| 5,751,301 | A | 5/1998 | Saikawa et al. | 347/8 |
| 5,933,172 | A | 8/1999 | Park et al. | 347/85 |

(Continued)

FOREIGN PATENT DOCUMENTS

EP 967083 12/1999

(Continued)

*Primary Examiner*—Anh T. N. Vo
(74) *Attorney, Agent, or Firm*—Fitzpatrick, Cella, Harper & Scinto

(57) ABSTRACT

An ink cartridge which is detachably mountable to an ink cartridge mounting portion of a recording device, the recording device having an ink jet recording head which is provided with a head side connecting portion which functions upon intermittent ink filling, the ink cartridge being provided with a cartridge side connecting portion which is connectable with the head side connecting portion, and the ink cartridge being capable of containing ink to be supplied through the cartridge side connecting portion, the ink cartridge includes a power receiving portion, wherein an intermittent connection between the head side connecting portion and the cartridge side connecting portion is effected using rotation, the receiving portion being effective to receive power for the rotation; wherein the power receiving portion and the cartridge side connecting portion are disposed in a region adjacent one end portion of the ink cartridge.

3 Claims, 13 Drawing Sheets

U.S. PATENT DOCUMENTS

| | | | | |
|---|---|---|---|---|
| 5,949,459 | A * | 9/1999 | Gasvoda et al. | 347/86 |
| 5,971,533 | A * | 10/1999 | Kinoshita et al. | 347/86 |
| 6,010,201 | A | 1/2000 | Shimoda | 347/7 |
| 6,030,073 | A | 2/2000 | Coiner et al. | 347/84 |
| 6,065,829 | A | 5/2000 | Ruiz et al. | 347/85 |
| 6,095,635 | A | 8/2000 | Kinoshita et al. | 347/36 |
| 6,109,740 | A | 8/2000 | Namekawa et al. | 347/85 |
| 6,120,128 | A | 9/2000 | Kawakami et al. | 347/37 |
| 6,120,140 | A | 9/2000 | Hirosawa et al. | 347/93 |
| 6,227,661 | B1 * | 5/2001 | Hayakawa | 347/86 |
| 6,247,806 | B1 | 6/2001 | Matsumoto et al. | 347/87 |
| 6,276,783 | B1 | 8/2001 | Ishinaga et al. | 347/65 |
| 6,331,043 | B1 | 12/2001 | Shimazu et al. | 347/48 |
| 6,450,631 | B1 * | 9/2002 | Hayashi et al. | 347/86 |
| 6,505,915 | B2 | 1/2003 | Asakawa et al. | 347/65 |
| 6,663,230 | B2 | 12/2003 | Asakawa et al. | 347/65 |
| 6,705,714 | B1 * | 3/2004 | Petranek | 347/86 |
| 6,827,430 | B2 | 12/2004 | Tsujimoto et al. | 347/85 |
| 6,966,631 | B2 * | 11/2005 | Matsuo et al. | 347/49 |
| 7,014,306 | B2 * | 3/2006 | Netsu et al. | 347/86 |
| 2003/0160848 | A1 | 8/2003 | Taniguchi et al. | 347/86 |
| 2005/0270344 | A1 * | 12/2005 | Tsujimoto et al. | 347/86 |

FOREIGN PATENT DOCUMENTS

| | | |
|---|---|---|
| EP | 968830 | 1/2000 |
| EP | 1186422 | 3/2002 |
| EP | 1375155 | 1/2004 |
| JP | 10-166612 | 6/1998 |
| JP | 10-235893 | 9/1998 |
| JP | 2000-15826 | 1/2000 |

* cited by examiner (a)

(b)

(a)

(b)

INK CARTRIDGE

TECHNICAL FIELD

The present invention relates to an ink cartridge.

BACKGROUND ART

A serial type ink jet recording apparatus has long been known. It comprises: an ink jet head which records by ejecting ink; and a replaceable ink cartridge which stores recording ink. The ink jet head and ink cartridge are mounted on the carriage of the recording apparatus. The recording apparatus records by shuttling the carriage in a manner to scan recording medium, in the direction perpendicular to the direction in which recording medium is discharged. This recording method makes it possible to replace the ink cartridge without replacing the ink jet head, which is rather expensive. Therefore, it reduces recording cost.

This recording method, however, has its own problem. That is, in the case of this recording method, as the ink jet head is reciprocally moved across the surface of the recording medium, the ink cartridge is also reciprocally moved along with the ink jet head. Therefore, the recording apparatus is required to large enough to afford an internal space in which the carriage holding both the ink jet head and ink cartridge can be shuttled. This makes it difficult to reduce the size of an ink jet recording apparatus. Further, if a large ink cartridge is employed, not only must the carriage driving portion of the recording apparatus be increased in size in order to stabilize the speed at which the carriage is shuttled, but also, the ranges necessary to accelerate or decelerate the carriage must be increased in length. In other words, the employment of this recording method contradicts the effort to reduce the size of a recording apparatus.

As a solution to the above described problem, there have been proposed a few ink jet recording apparatuses in which the ink cartridge is not mounted on the carriage. For example, there has been proposed a recording apparatus in which a large ink cartridge is positioned away from the carriage, and its head is connected to the ink cartridge with the use of a tube. There has been also proposed a recording apparatus in which its head is intermittently supplied with ink, that is, it is supplied as necessary; more specifically, the ink cartridge and ink jet head are directly connected to each other to supply the ink jet head with ink, only as the amount of the ink remaining in the ink jet head falls below a predetermined value (this type of recording apparatus hereinafter may be referred to as pit-in type, for convenience). Referring to FIG. 13, as an example of the pit-in type recording apparatus, there is a recording apparatus structured so that as the carriage 1012 reaches the pit, the entirety of the connective portion 1010 is pulled out of the ink cartridge and moved to be connected to the head (Japanese Laid-open Patent Application (corresponding to U.S. Pat. No. 6,030,073).

In the case of the tube type recording apparatus in accordance with the prior art, the recording apparatus requires a mechanism and/or space for preventing the tube from being critically bent. Further, a larger motor is necessary to provide the force for moving the combination of the carriage and the tube, that is, the combination of the weights of the carriage and tube, inclusive of the ink therein. Thus, it is difficult to reduce the size of an ink jet recording apparatus.

On the other hand, in the case of the pit-in type recording apparatus, the connective portion of an ink cartridge must be precisely moved so that the connective portion of the ink cartridge and the counterpart of the head remain parallel to each other while they are moved relative to each other. This complicates the mechanism for driving the connective portions. Further, the connective portions must be made rigid enough to prevent the connective portions from deforming due to the load to which they are subjected when they are connected to each other. These requirements makes it difficult to reduce the size of the pit-in type recording apparatus. Moreover, if the pit-in type ink jet recording apparatus reduces in the accuracy with which the connective portion of an ink cartridge is moved relative to the ink jet head of the recording apparatus main assembly so that it remains parallel to the counterpart of the recording head the apparatus, it reduces in the reliability in terms of the connection between its ink jet head and an ink container; in other words, ink leaks from the joint and/or air is suctioned into the ink supply line, causing thereby the ink jet head to be insufficiently supplied with ink. Further, the pit-in type ink jet recording apparatus requires a relatively large amount of mechanical force to drive the complicated mechanism for moving the connective portions, being therefore relatively large in electrical power consumption, which in turn makes it difficult to operate the pit-in type recording apparatus for a long time using only the internal power source; in reality, the pit-in type ink jet recording apparatus requires an external power supply. This makes it difficult to provide a small and light portable ink jet recording apparatus.

DESCRIPTION OF THE INVENTION

The primary object of the present invention is to provide an ink cartridge which makes it possible to substantially reduce an ink jet recording apparatus in size and weight.

According to an aspect of the present invention, there is provided an ink cartridge which is detachably mountable to an ink cartridge mounting portion of a recording device, said recording device having an ink jet recording head which is provided with a head side connecting portion which functions upon intermittent ink filling, said ink cartridge being provided with a cartridge side connecting portion which is connectable with the head side connecting portion and said ink cartridge being capable of containing ink to be supplied through said cartridge side connecting portion, said ink cartridge comprising a power receiving portion, wherein an intermittent connection between said head side connecting portion and said cartridge side connecting portion is effected using rotation, said receiving portion being effective to receive power for the rotation; wherein said power receiving portion and said cartridge side connecting portion are disposed in a region adjacent one end portion of said ink cartridge.

According to another aspect of the present invention, there is provided an ink cartridge which is detachably mountable to an ink cartridge mounting portion of a recording device, said recording device having an ink jet recording head which is provided with a head side connecting portion which functions upon intermittent ink filling, said ink cartridge being provided with a cartridge side connecting portion which is connectable with the head side connecting portion, and said ink cartridge being capable of containing ink to be supplied through said cartridge side connecting portion, said ink cartridge includes ink accommodation members for independently accommodating three different color inks for color recording, wherein said ink accommodation members are in fluid communication with said cartridge side connecting portion; a collecting portion for collecting inks which have not been used for recording, said collecting portion having an ink absorbing member; an elastic seal member provided at said cartridge side connecting portion; and a power receiving portion, wherein an intermittent connection between said head side connecting portion and said cartridge side connecting portion is effected using rotation, said receiving portion being effective to receive power for the rotation; wherein said power receiving portion and said cartridge side connecting portion are disposed in a region adjacent one end portion of said ink cartridge.

As described above, according to the present invention, the ink cartridge is provided with a rotational force receiving portion for receiving the rotational force transmitted to the ink cartridge from the main assembly of an ink jet recording apparatus, and the tubes connected to the recording head of the ink jet recording apparatus are inserted into the connective holes of the connective portion of the ink container, by the rotation of the ink cartridge caused by the rotational force received by the rotational force receiving portion of the ink cartridge. In other words, the ink cartridge in accordance with the present invention can be connected to the recording head through the rotational movement of the ink cartridge. Therefore, it is substantially smaller in the distance the ink cartridge must be moved for the connection, and the amount of the force necessary for the connection, compared to an ink jet recording apparatus in which the connection is made by vertically moving the ink cartridge while keeping the surface of the connective portion parallel to the counterpart of the ink jet head.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 4(*b*) is a perspective view of the ink cartridge, as seen from the side having a groove; and FIG. 4(*c*) is a top plan view of the ink cartridge.

BEST MODE FOR CARRING OUT THE INVENTION

Next, the preferred embodiments of the present invention will be described with reference to the appended drawings.

Embodiment 1

Figure 1:
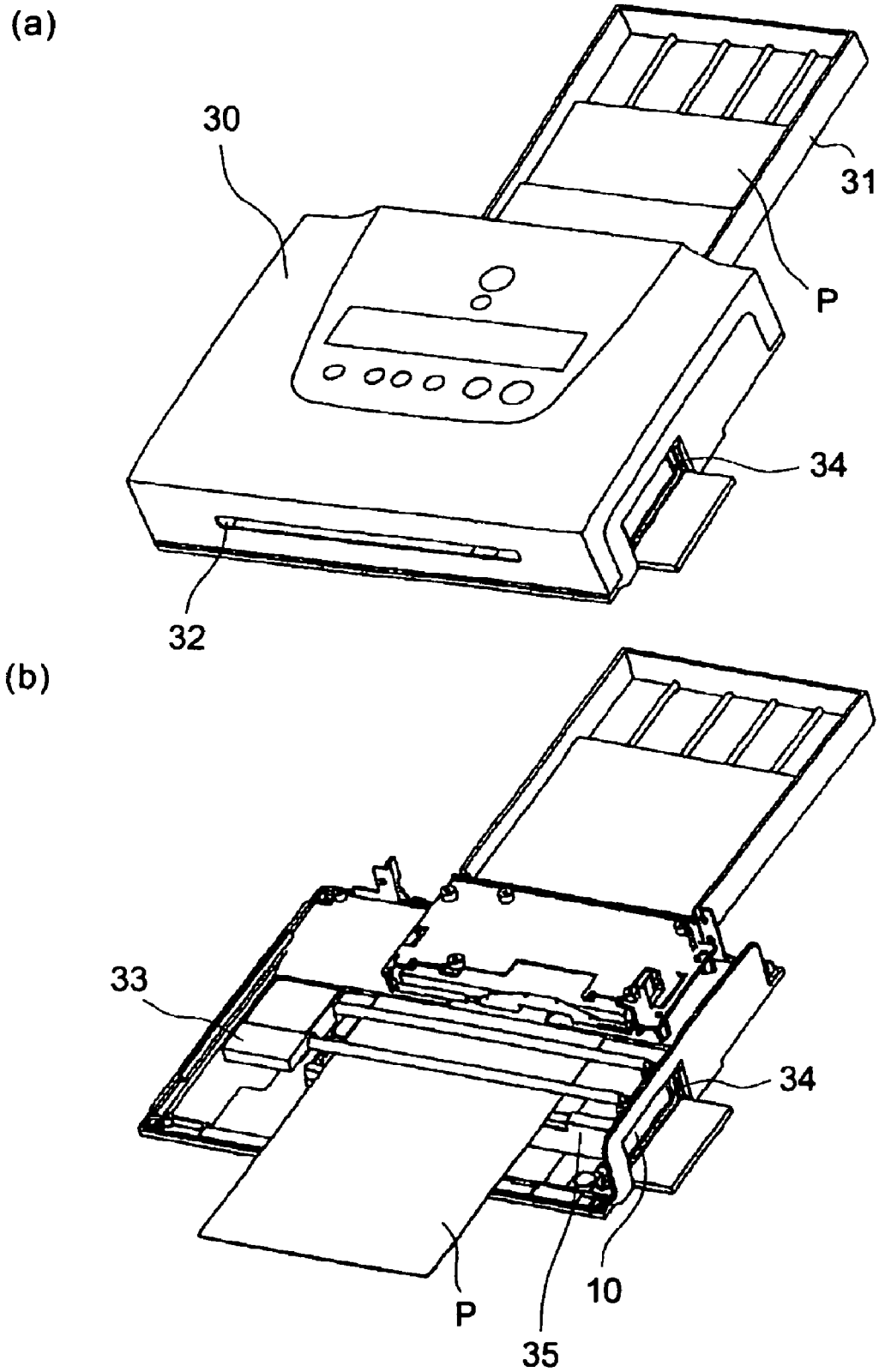
FIG. 1(*a*) is an external perspective view of the ink jet recording apparatus in the first embodiment of the present invention, and FIG. 1(*b*) is an internal perspective view of the same, showing the internal structure thereof.
Figure 2:
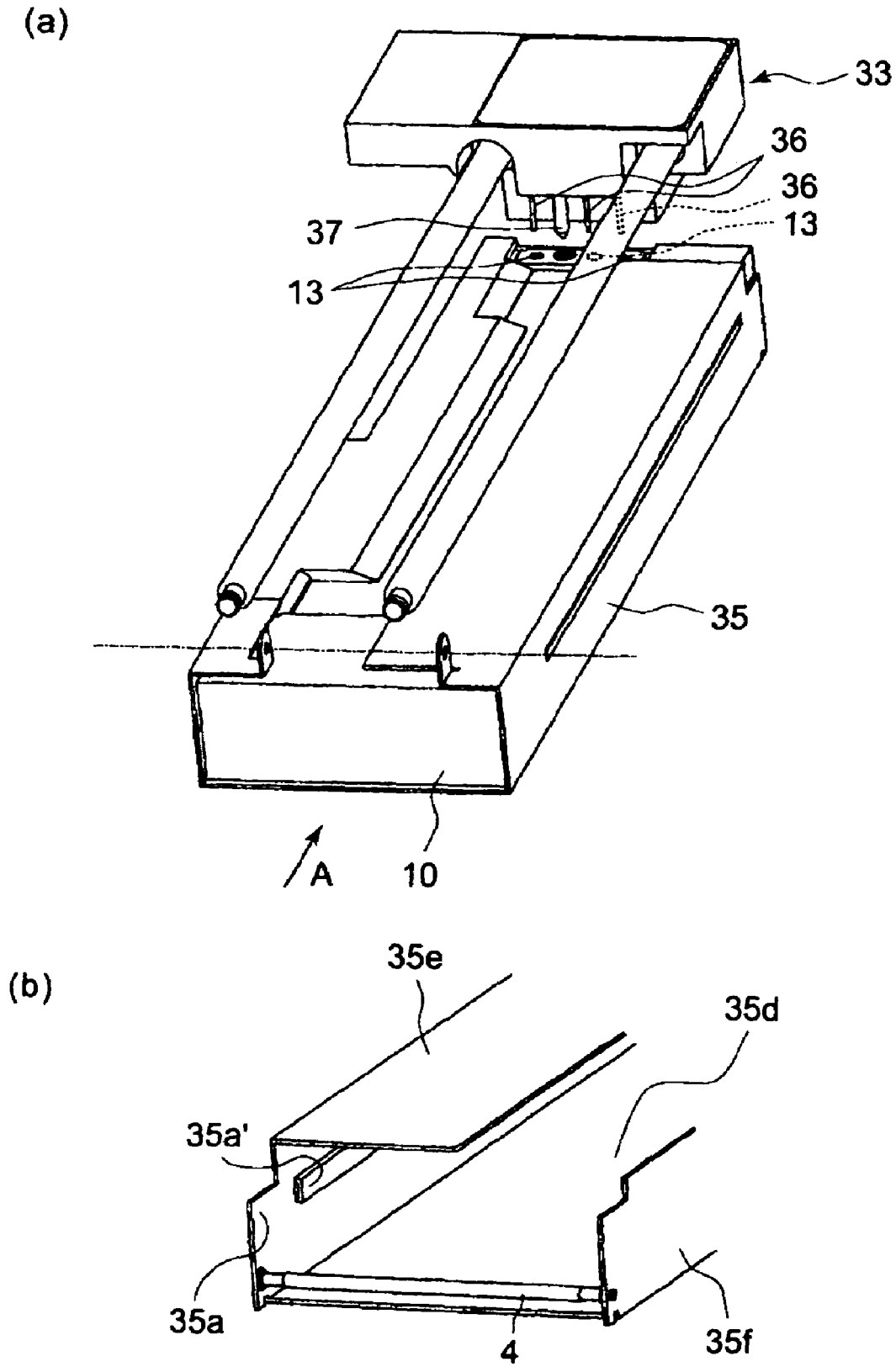
FIG. 2 is a schematic perspective view of the ink cartridge chamber and ink jet head, in the first embodiment of the present invention.
Figure 3:
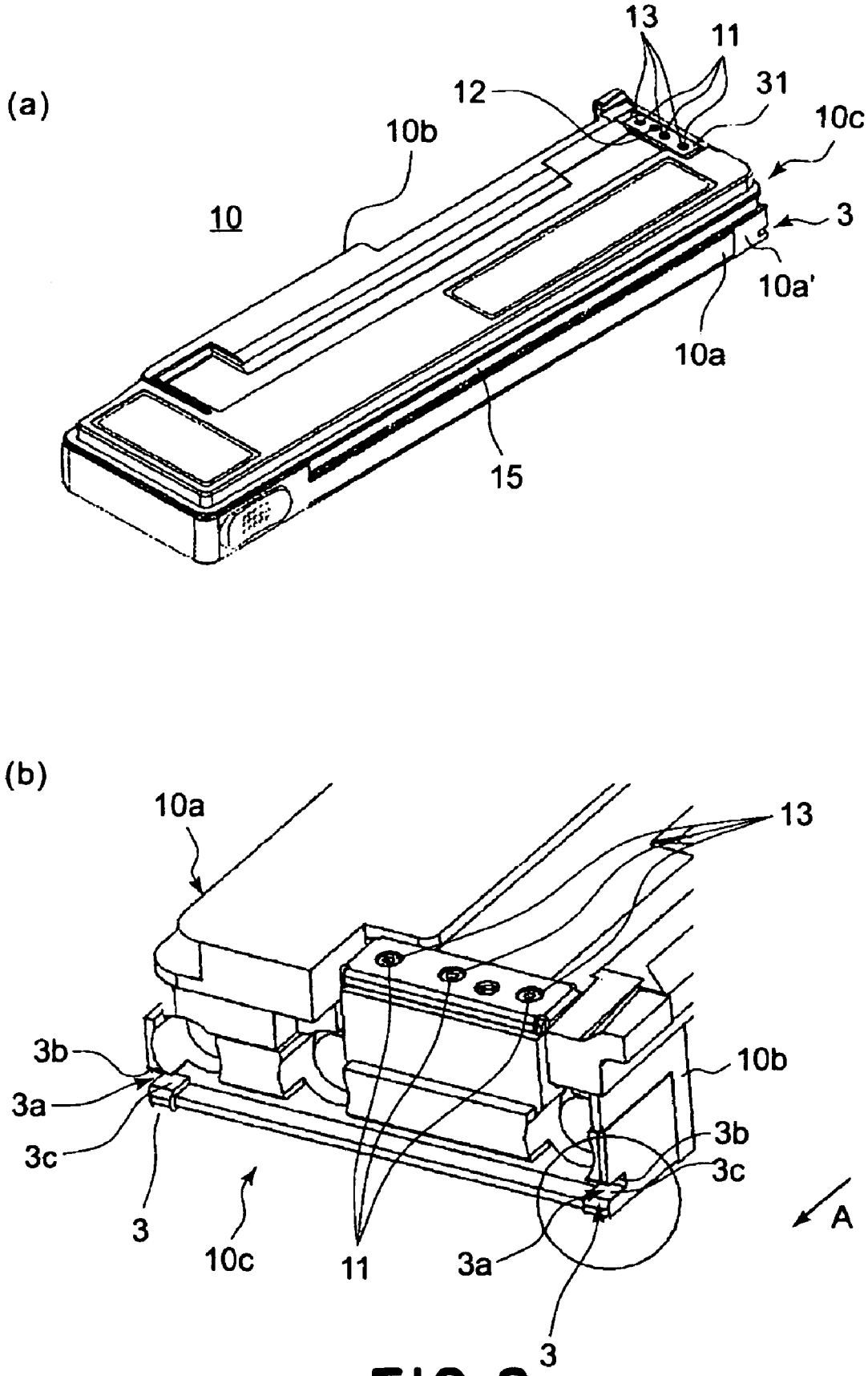
FIG. 3(*a*) is an external perspective view of the ink cartridge in the first embodiment of the present invention, and FIG. 3(*b*) is an enlarged perspective view of the rotational force transmitting portion of the ink cartridge compartment, and its adjacencies.

FIG. 1(*a*) is an external perspective view of the ink jet recording apparatus in this embodiment, and FIG. 1(*b*) is an internal perspective view of the same, showing the internal structure thereof. FIG. 2(*a*) is a schematic perspective view of the ink cartridge compartment in which an ink cartridge is mounted, and an ink jet head, and FIG. 2(*b*) is an enlarged perspective view of the rotational force transmitting portion of the ink cartridge compartment, and its adjacencies. FIG. 3(*a*) is an external perspective view of the ink cartridge, and the ink cartridge compartment in which the ink cartridge is present, and FIG. 3(*b*) is an enlarged perspective view of the rotational driving force transmitting portion of the ink cartridge compartment, and its adjacencies.

The ink jet recording apparatus 30 shown in FIG. 1 employs a sheet feeder cassette 31, which is removably mountable in the back side of the ink jet recording apparatus 30, and in which a plurality of sheets of recording paper P to be fed into the main assembly of the recording apparatus are stored in layers. The front wall of the ink jet recording apparatus 30 is provided with a recording paper outlet 32, through which the recording paper P is discharged after the recording of an image on the recording paper P. A desired image is recorded by the ink ejected from the ink jet head 33 on the recording paper P fed into the recording apparatus main assembly, while the ink jet head 33 is shuttled in the direction intersectional to the recording paper conveyance direction. Ink is ejected from the ink jet head; the liquid in each of the nozzles of the ink jet head is pushed out of the nozzle by thermal energy generated by a heat generating element, or vibratory energy generated by a piezoelectric element (unshown).

The ink cartridge 10 in which the ink used for recording is stored is replaceable through the ink cartridge replacement hole 34 of the one of the side walls of the recording apparatus. More specifically, it is inserted into the ink cartridge compartment 35 in the recording apparatus main assembly, in the direction indicated by an arrow mark A in FIG. 1(*a*) through the ink cartridge replacement hole 34. After the insertion of the ink cartridge 10 into the recording apparatus main assembly, it is directly below the area through the recording paper P is conveyed.

Figure 13:
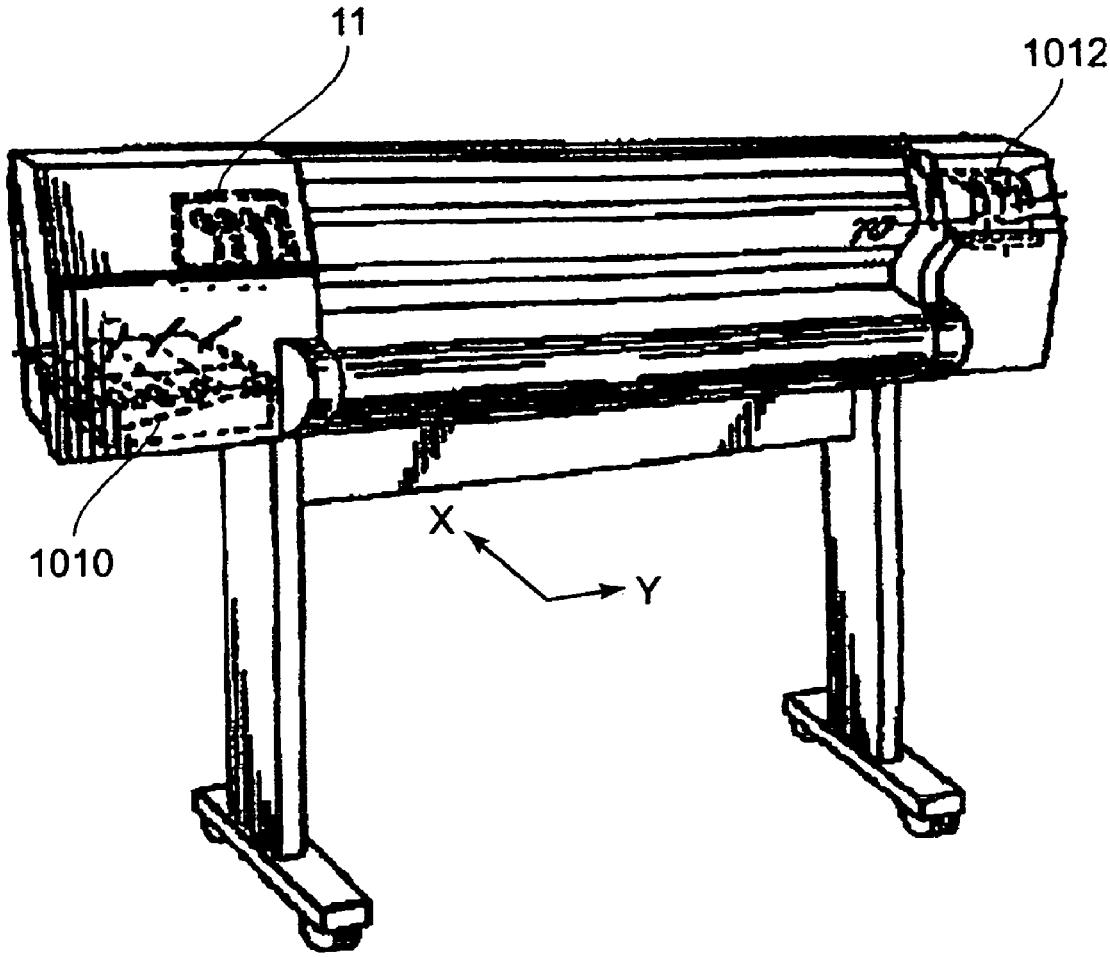
FIG. 13 is an external perspective view of a typical pit-in type ink jet recording apparatus in accordance with the prior art.

Referring to FIG. 2(*a*), the ink jet head comprises: an ink ejecting portion (unshown) through which ink is ejected; and an ink chamber in which the ink to be supplied to the ink ejecting portion is stored. The ink chamber is provided with three sub-chambers in which inks Y (yellow), M (magenta), and C (cyan) are stored one for one. Each sub-chamber is connected to the three cylindrical hollow needles 36, one for one, which extend straight downward from the bottom wall of the ink jet head 20, being aligned in the direction perpendicular to the ink cartridge insertion direction. Each of these three needles 36 in this embodiment is 0.5 mm in external diameter and 0.32 mm in internal diameter. The ink jet head 20 is also provided with a positioning needle 37, which also extends downward from the bottom wall of the ink jet head 20. The method used in this embodiment to supply the ink jet head 20 with ink is the so-called pit-in method, that is, an ink supplying method in which the cylindrical hollow needles 36 of the ink jet head 33 are inserted into the connective holes 11 (FIG. 13) of the ink cartridge 10 to supply the ink chambers of the ink jet head 33 with the ink in the ink cartridge 10 as necessary. Thus, when inserting the cylindrical hollow needles 36 of the ink jet head 33 into the connective holes 11, the cylindrical hollow needles 36 must be precisely aligned with the connective holes 11. This is why the ink jet head 33 is provided with the positioning needle 37, which is for precisely aligning them. The positioning needle 37 in this embodiment is between the needle 36 for the ink Y and the needle 36 for the ink M. The details of the method used in this embodiment to supply the ink jet head 33 with ink will be described later.

The ink cartridge 10 shown in FIG. 3(*a*) contains three ink pouches (unshown), which are for storing the ink Y, ink M, and ink C, one for one. The three ink pouches are vertically stacked. They are formed by thermally welding two pieces of film, which are 32 mm in width, 130 mm in length, and 0.1 mm in thickness, being therefore capable of deforming as the ink therein is drawn out. When they are full of ink, they are 3 mm thick. The ink jet recording apparatus is designed to periodically carry out the ejection performance recovery operation. Thus, each ink pouch is filled with 4 milliliters of ink, which is the total of the ink necessary to output 50 prints and the ink necessary for the recovery operations.

Also referring to FIG. 3(*a*), the top wall of the ink cartridge 10 is provided with a hole, through which an ink absorbing member is exposed. In other words, the top portion of the ink cartridge 10 constitutes an ink recovery portion for recovering the ink ejected toward slightly outside the edges of the recording medium during the actual recording operation, that is, the ink which does not literally contribute to image formation.

Next, referring to FIG. 3(*b*), the ink cartridge 10 is provided with a 0.7 mm thick connective portion 13, which is formed of butyl rubber. The connective portion 13 is located at the top of one of the lengthwise ends of the ink cartridge 10. It has the aforementioned three connective holes 11 into which the cylindrical hollow needles, also aforementioned, for supplying the ink jet head 33 with ink, are inserted. The connective portion 13 is also provided with a positioning hole 12 into which the aforementioned positioning needle 37 is inserted. The three connective holes 11 and positioning holes 37 are aligned virtually in a straight line in the direction perpendicular to the lengthwise direction of the ink cartridge 10.

The pressure which the hollow cylindrical hollow needles 36 generate in the connective portion 13 as they are put through the connective holes 11 mostly turns into the internal stress of the connective portion 13 formed of butyl rubber. In other words, as the needles 36 are put through the connective holes 11, the connective portion 13 formed of butyl rubber is more or less damaged by the needles 36. Thus, by minimizing this damage, it is possible to raise the reliability of the joint, that is, to prevent the joint from allowing ink to leak therefrom. In order to accomplish this objective, the connective holes 11 in this embodiment are provided with a plurality of 0.5 mm long slits. With the provision of these slits, the pressure necessary to be applied per needle to put three needles 36 through the connective holes 11 was reduced to 1.3 N from 11 N necessary to be applied when the holes 11 are not provided with the slits. Although in this embodiment, the cylindrical hollow needles 36 are employed to reduce the cost of the recording medium main assembly, the employment of such needles as the cylindrical hollow needles 36 in this embodiment is not mandatory. In other words, they may be replaced with needles having an ink drawing hole in the side wall, away from the needle tip; for example, needles which are 0.2 mm in tip SR, 0.3 mm in taper length, and the ink drawing hole of which is 1.0 mm away from the tip. The employment of such needles can further reduce the amount of mechanical load which applies to the connective portion 13 during the insertion of the needles 36. The connective portion 13 is positioned at the leading end of the ink cartridge 10, in terms of the ink cartridge insertion direction, so that its surface, at which the connective holes 11 are open, becomes roughly perpendicular to the direction in which the cylindrical hollow needles 36 are inserted into the ink cartridge or removed therefrom.

As for the insertion of the cylindrical hollow needles 36 into the connective holes 11, as the ink cartridge 10 is rotated about the rotational axis 100, which will be described later, the needles 36 are inserted into the holes 11. Thus, the connective holes 11 are aligned so that their openings align in the direction parallel to the rotational axis 100, in order to assure that the connection between the needle 36 for one ink and corresponding connective hole 11 will not differ in reliability from the connection between the needle 36 for another ink and corresponding connective hole. The surface of the connective portion 13, at which the connective holes 11 are open, is tilted by an angle of θ1 relative to the direction in which the ink cartridge 10 is inserted into the ink cartridge compartment 35 (FIG. 8(*a*)). This angle θ1 is made equal to the angle θ2 by which the ink cartridge 10 is rotated (FIG. 8(*b*)), for the following reason. That is, with the angle θ1 being equal to the angle θ2, as the ink cartridge 10 is rotated about the rotational axis 100, the axial line of each cylindrical hollow needle 36 becomes perpendicular to the surface of the ink cartridge 10, at which the needle 36 open, at the moment the needle 36 begins to enter the corresponding connective hole 11. Therefore, the force necessary to further rotate the ink cartridge 10 to put the cylindrical hollow needles 36 through the connective holes 11 is smaller, and therefore, the mechanical force required of the recording apparatus main assembly is smaller. In this embodiment, the tilt angle θ1=rotational angle θ2=1.25°.

Figure 4:
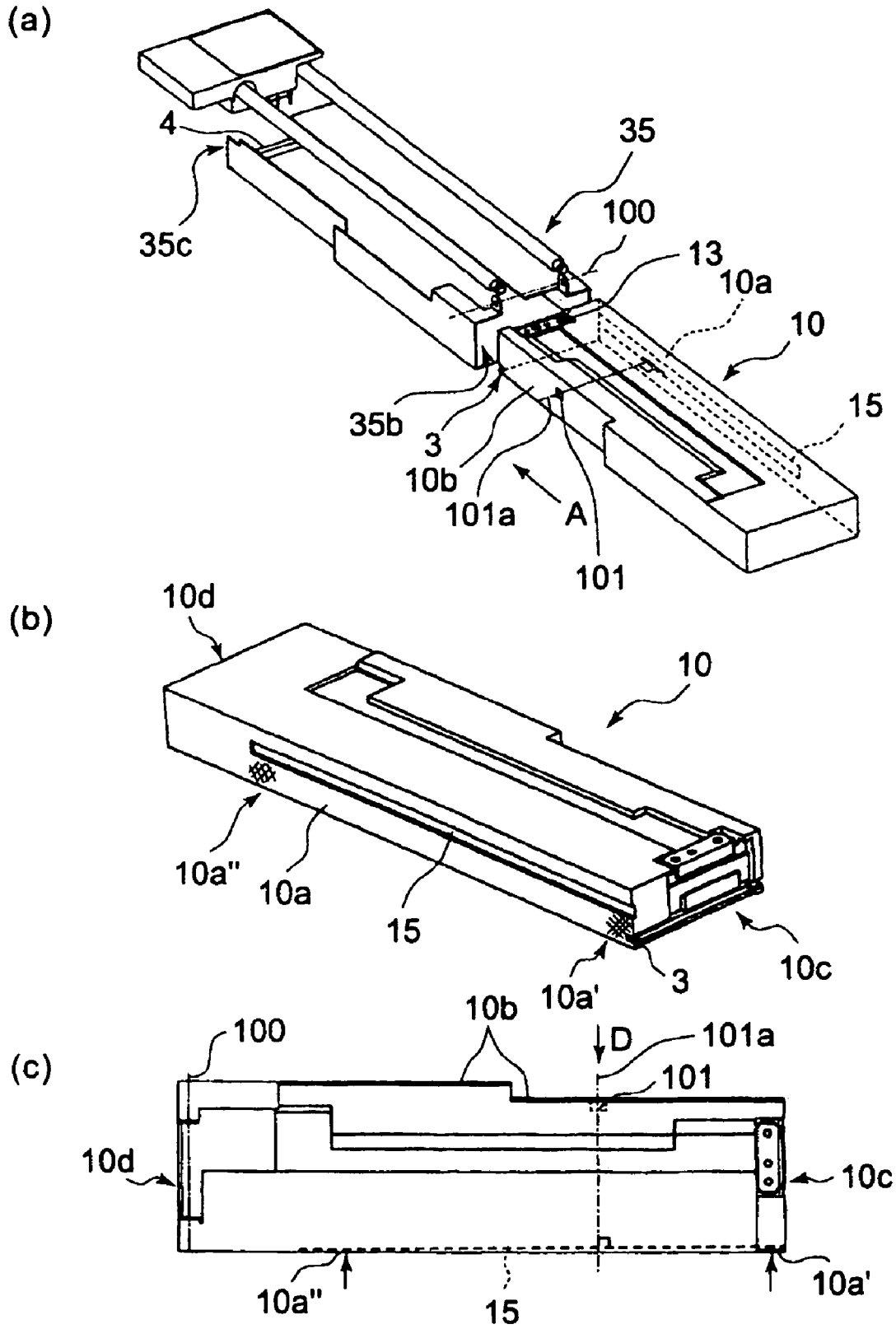
FIG. 4(*a*) is a perspective view of the ink cartridge ready to be inserted into the ink cartridge chamber.
Figure 5:
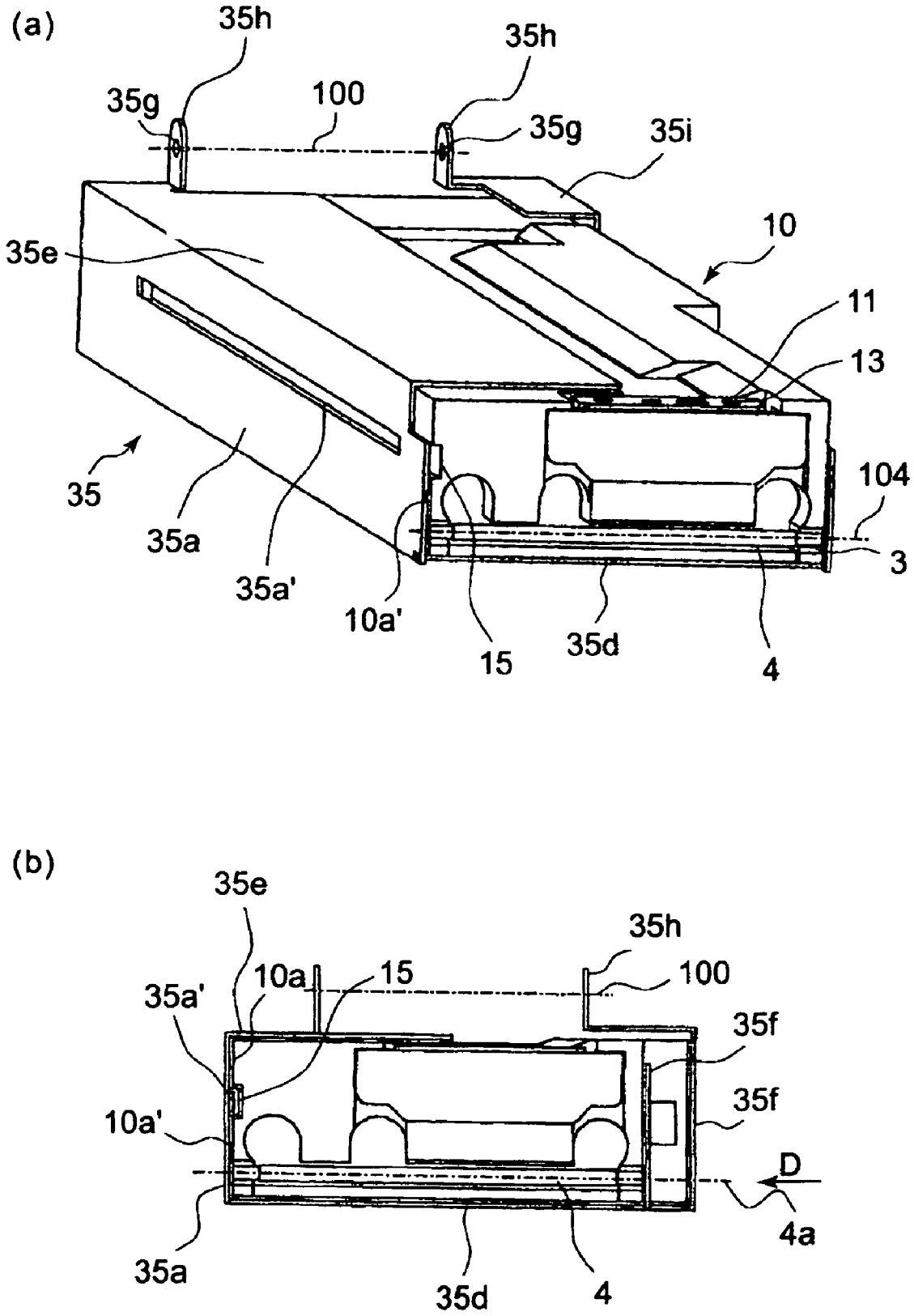
FIG. 5(*a*) is a perspective view of the combination of the ink cartridge, and the ink cartridge compartment in which the ink cartridge is present, and FIG. 5(*b*) is a front view of the same.

FIG. 4(*a*) is a perspective view of the ink cartridge and ink cartridge compartment, prior to the insertion of the ink cartridge into the ink cartridge compartment, and FIG. 4(*b*) is a perspective view of the ink cartridge, as seen from the direction of the first side wall side, that is, the side wall having a groove. FIG. 4(*c*) is a top plan view of the ink cartridge. FIG. 5(*a*) is a perspective view of the ink cartridge and ink cartridge compartment, after the insertion of the ink cartridge into the ink cartridge compartment, and FIG. 5(*b*) is a plan view of the ink cartridge, as seen from the direction of the connective portion.

The ink cartridge 10 is provided with a pair of rotational force receiving portions 3, which are located on the front end 10*c* where the connective portion 13 is located, that is, the opposite end of the ink cartridge 13 from the rotational axis 100. More specifically, one of the rotational force receiving portion 3 is located at the corner at which the font edge of the first side wall 10*a*, and the front edge of the bottom wall, of the ink cartridge 10 meet, and the other is located at the corner at which the front edge of the second side wall 10*b*, and the front edges of the bottom wall, of the ink cartridge 10 meet. Each rotational force receiving portion 3 is provided with a notch 3*a*, which faces the direction in which the ink cartridge 10 is inserted into the ink cartridge compartment 35 (direction indicated by arrow mark A). It is also provided with first and second rotational force catching surfaces 3*b* and 3*c*, which are parallel to each other. The rotational force receiving portions 3 are for receiving the force transmitted thereto from the rotational force transmitting portion 4 of the ink cartridge compartment 35 in order to make the cylindrical hollow needles 36 of the ink jet head 33 move relative to the connective holes 11 in the direction to enter the connective holes 11, or come out of them. Thus, in order to keep the surface of the ink cartridge 10 having the connective holes 11 parallel to the surface of the ink jet head from which the needles 36 and positioning needle 37 project, the first and second rotational force catching surfaces 3*b* and 3*c* are made parallel to each other. Incidentally, for the following reason, the first and second rotational force catching surfaces 3*b* and 3*c* have only to be made roughly parallel to the normal line relative to the line tangential to the arc a given point of the ink cartridge 10 forms as the ink cartridge 10 is rotated about the rotational axis 100. That is, the force applied from the rotational transmitting portion 4 to the ink cartridge 10 acts in the direction parallel to the line tangential to the arc which a given point on the ink cartridge 10 forms as the ink cartridge 10 is rotated about the axial line 100. Thus, all that is necessary is for the first and second rotational force catching surfaces 3*b* and 3*c* to be perpendicular to the direction in which the ink cartridge 10 is rotated. The distance between the first and second rotational force catching surfaces 3*b* and 3*c* of the ink cartridge 10 in this embodiment is 1.3 mm.

The first side wall 10*a* of the ink cartridge 10 is provided with a groove 15, which extends in the direction parallel to the direction in which the ink cartridge 10 is inserted into the ink jet recording apparatus 30. When the ink cartridge 10 is inserted into the recording apparatus 30, the rib 35*a*', with which the first side wall 35*a* of the ink cartridge compartment 35*a*, which corresponds in position to the first side wall 10*a* of the ink cartridge 10, fits in this groove 15, and guides the ink cartridge 15. In other words, the groove 15 facilitates the insertion of the ink cartridge 10 into the ink cartridge compartment 35. The groove 15 in this embodiment is 3 mm in width and 1 mm in depth.

As the ink cartridge 10 is inserted into the ink cartridge compartment 35, it comes under the pressure which applies to the second side wall 10*b* thereof from the direction indicated by an arrow mark D in FIG. 4(*c*). Therefore, during and after the insertion, the ink cartridge 10 is kept in contact with the first side wall 35*a* of the ink cartridge compartment 35 (FIG. 5). As for the referential surface for accurately positioning the ink cartridge 10 in terms of the direction indicated by the arrow mark D, the area 10*a*' of the first surface 10*a* of the ink cartridge 10, that is, the area next to the rotational force receiving portion 3, is used as the first referential area. The first referential area 10*a*' is perpendicular to the rotational axis 100. The force which acts in the direction to pressure the ink cartridge 10 in the arrow D direction is caught by the first side wall 35*a* of the ink cartridge compartment 35, with which the first and second referential areas 10*a*' and 10*a*" of the ink cartridge 10 come into contact. The first and second referential areas 101' and 101" are the two hatched areas of the first side wall 10*a* of the ink cartridge 10, in FIG. 10(*b*).

The second side wall 10*b* of the ink cartridge 10, which is parallel to the side wall 10*b* of the ink cartridge 10, is provided with a recess 101 as the ink cartridge positioning portion, into which the ink cartridge positioning portion of the main assembly side of the recording apparatus 30 fit. This recess 101 is located so that it falls within the projection of the groove 15 upon the side wall 10*b*. The imaginary perpendicular 111*a* drawn from the recess 101 to the second side wall 10*b* in the direction perpendicular to the second side wall 10*b* is parallel to the rotational axis 100 of the ink cartridge 10. The force for keeping the ink cartridge 10 pressured in the aforementioned arrow D direction is applied to the bottom surface of this recess 101. The distance of the recess 101 from the bottom of the ink cartridge 10 may be the same as those of the first and second referential areas 10*a*' and 10*a*".

Referring to FIGS. 2(*b*), 5(*a*), and 5(*b*), roughly speaking, the ink cartridge compartment 35 is made up of: the bottom wall 35*d*, which supports the ink cartridge 10 by the bottom wall 10*c* of the ink cartridge 10; first side wall 35*a* having the above described rib 35*a*'; the second side wall 35*f*, that is, the wall opposite from the first side wall 35*a*: and the platen 35*e*, which partially covers the top surface of the ink cartridge 10, and supports the recording paper P. The ink cartridge compartment 35 is also provided with a rotational force transmitting portion 4 in the form of a rod. The rotational force transmitting portion 4 is located at the lengthwise end 35*c*, which is the opposite end of the compartment 35 from the lengthwise end 35*b* from which the ink cartridge 10 is inserted into the compartment 35. The rotational force transmitting portion 4 extends from the first side wall 35*a* of the compartment 35 to the second side wall 35*b* of the compartment 35. The portion of the rotational force transmitting portion 4, which fits in the rotational force receiving portion 3 is 1.3 mm in diameter.

Figure 7:
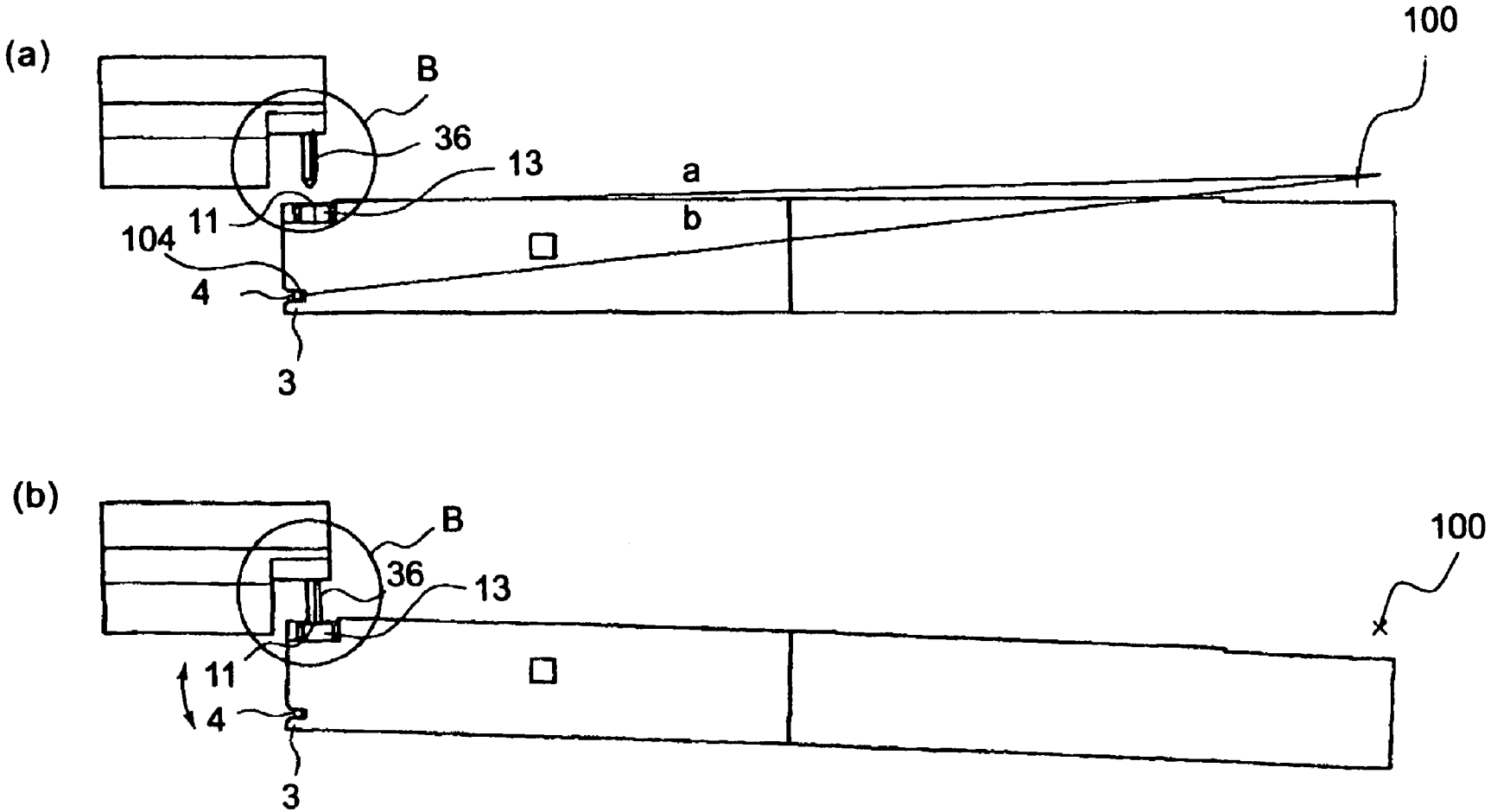
FIG. 7(*a*) is a side view of the combination of the ink cartridge, and the ink jet head, the cylindrical hollow needles of which are ready to be inserted into the holes of the joint portion of the ink cartridge, and FIG. 7(*b*) is a side view of the combination of the ink cartridge, and the ink jet head, the cylindrical hollow needles of which have been inserted into the holes of the joint portion of the ink cartridge.

The ink cartridge compartment 35 is also provided with a pair of bearing portions 35*h* having a through hole 35*g* through which an unshown shaft is put. The aforementioned rotational axis 100 of the ink cartridge 10 coincides with the axial line of this unshown shaft. The pair of bearing portions 35*h* are roughly perpendicular to the platen 35*e* and a surface 35*i*. The rotational axis 100, that is, the axial line of the unshown shaft, is perpendicular to the first side wall 35*a* of the ink cartridge compartment 35, and parallel to the axial line 104*a* of the rotational force transmitting portion 4. The rotational axis 100 is at the diagonally opposite end of the ink cartridge compartment 35 from the axial line 104*a* of the rotational force transmitting portion 4, in terms of the lengthwise direction of the ink cartridge compartment 35. More specifically, the rotational axis 100 and rotational force receiving portion 3 are positioned, as shown in FIG. 7(*a*), so that their positional relationship satisfies the following inequality: $a \leqq b$ (a is the distance from the rotational axis 100 to the connective portion 13, and b is the distance from the rotational axis 100 to the axial line 104*a* of the rotational force transmitting portion 4). The rotational force receiving portion 3 is the point of force application. Therefore, in order to reduce as much as possible the force necessary to rotate the ink cartridge 10, the distance b from the rotational axis 100, that is, the fulcrum, to the rotational force receiving portion 3 is desired to be greater than the distance a from the connective portion 13, that is, the point of action, to the rotational axis 100 as the fulcrum. However, simply making the distance b between the rotational force receiving portion 3 and rotational axis 100 contradicts with the effort to reduce the size of the ink cartridge 10. In this embodiment, therefore, in order to maximize the distance between the fulcrum and point of force application while minimizing the size of the ink cartridge 10, the ink cartridge compartment 35 and ink cartridge 10 are designed so that as the ink cartridge 10 is inserted into the ink cartridge compartment 35, the rotational force transmitting portion 4 and rotational force receiving portion 3 will be positioned diagonally opposite end of the ink cartridge compartment 35 from the rotational axis 100 of the ink cartridge compartment 35 in terms of the ink cartridge insertion direction. In this embodiment, a=140 mm, and b=146 mm. Therefore, the mechanical load upon the recording apparatus main assembly in this embodiment is substantially smaller compared to that upon the main assembly of an ink jet recording apparatus in accordance with the prior art.

Next, the insertion of the ink cartridge 10 into the ink cartridge compartment 35 will be described.

The ink cartridge 10 is inserted into the ink cartridge compartment 35, from the front side 10*c* having the connective portion 3, through the ink cartridge entrance 35*b* of the ink cartridge compartment 35. As the ink cartridge 10 is inserted, the rib 35*a*' of the first side wall 35*a* of the ink cartridge compartment 35 fits into the groove 15 of the first side wall 10*a* of the ink cartridge 10, and guides the ink cartridge 10 until the rotational force transmitting portion 4 of the ink cartridge compartment 35 fits into the rotational force receiving portion 3 of the ink cartridge 10, as shown in FIG. 5(*a*) or 5(*b*).

As the rotational force transmitting portion 4 fits into the rotational force receiving portion 3, the unshown ink cartridge positioning means of the recording apparatus main assembly latches into the aforementioned recess 100 as the ink cartridge positioning means of the ink cartridge 10, and the ink cartridge 10 is subjected to the force applied in the direction indicated by the arrow mark D through the recess 101. As a result, the first and second referential areas 10*a*' and 10*a*" of the first side wall 10*a* of the ink cartridge 10 are pressed on the first side wall 35*a* of the ink cartridge compartment 35 by this force.

Through the above described steps, the ink cartridge 10 is accurately and firmly positioned in the ink cartridge compartment 35, assuring that it does not slip out of the ink cartridge compartment 35. Because the ink cartridge 10 and ink cartridge compartment 35 are structured so that the pressure for keeping the ink cartridge 10 against the first side wall 35*a* of the ink cartridge compartment 35 is applied to a point in the range between the first and second referential areas 10*a*' and 10*a*" of the first side wall of the ink cartridge compartment 35, the ink cartridge 10 can be more reliably kept in the ink cartridge compartment 35, improving the positional relationship between the cylindrical hollow needles 36 and connective holes 11, compared to the combination of the ink cartridge and ink cartridge compartment in accordance with the prior art.

The gist of the present invention is the technologies for accurately controlling the positional relationship between the rotational axis 100, and the connective holes 11 of the connective portion 13. As described above, according to the present invention, not only are the connective holes 11 aligned in parallel to the rotational axis 100, but also, the first referential area 10*a*' is made perpendicular to the rotational axis 100. In other words, a surface (first referential area 10*a*') perpendicular to the rotational axis 100 is used as the referential surface for accurately positioning the ink cartridge 10. Therefore, the stress which affects the distance from the rotational axis 100 to the connective holes 11 is canceled whether or not the ink cartridge is rotated, and regardless of elapse of time. Therefore, the ink cartridge 10 is highly accurately positioned. As will be evident from the above description of the first embodiment of the present invention, the present invention can provide technologies highly useful for a recording apparatus equipped with a mechanism for rotating an ink cartridge to connect it to the ink jet head of the apparatus.

Next, referring to FIGS. 6-8, the insertion of the cylindrical hollow needles of the ink jet head into the connective holes of the ink cartridge, and removal of the needles therefrom, which occur when the ink jet head of the ink jet recording apparatus in this embodiment is supplied with ink, will be described.

Figure 6:
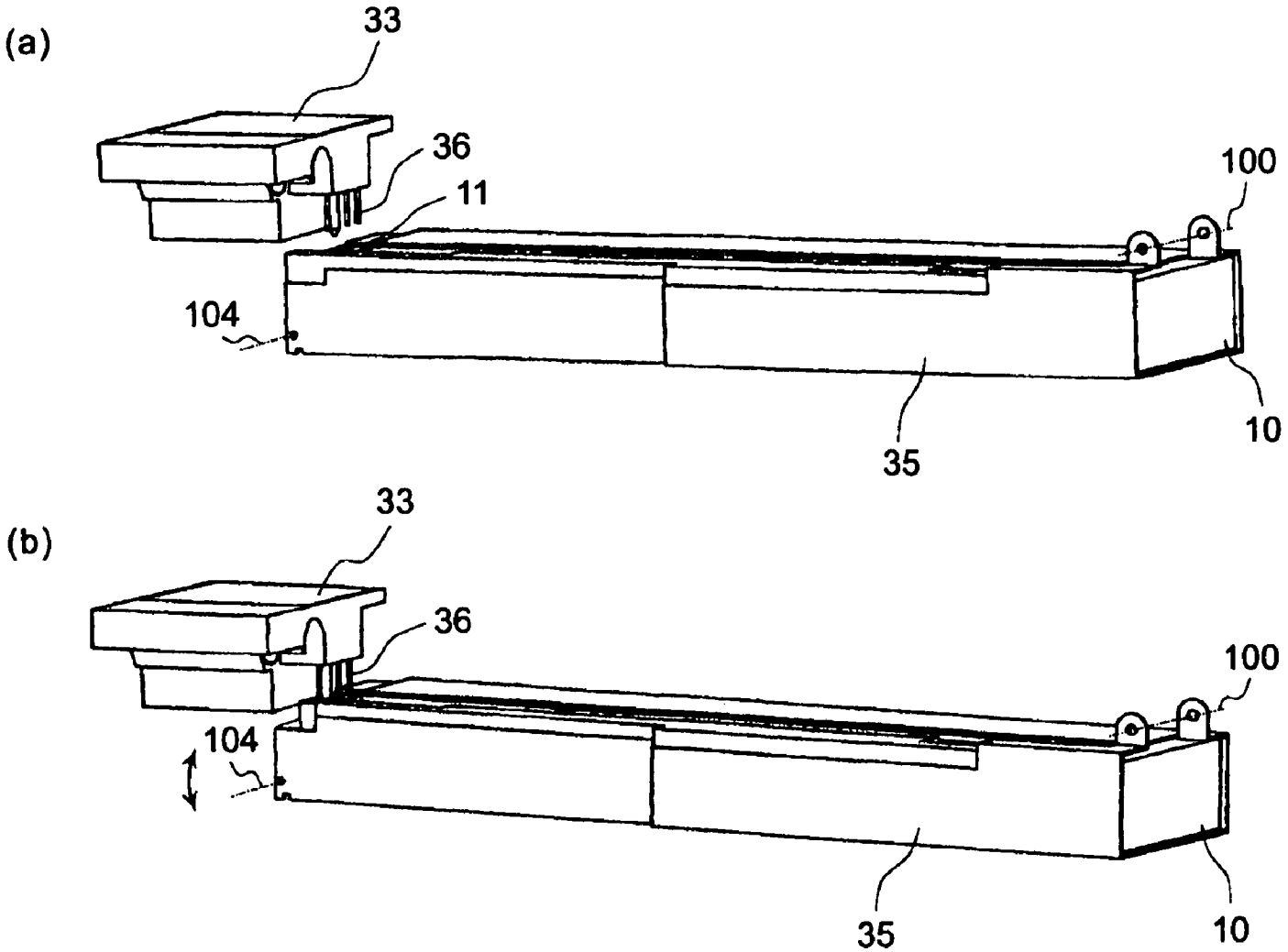
FIG. 6(*a*) is a perspective view of the combination of the ink cartridge, and the ink jet head, the cylindrical hollow needles of which are ready to be inserted into the holes of the connective portion of the ink cartridge, and FIG. 6(*b*) is a perspective view of the combination of the ink cartridge, and the ink jet head, the cylindrical hollow needles of which have been inserted into the holes of the connective portion of the ink cartridge.

FIG. 6(*a*) is a perspective view of the ink jet head and ink cartridge, prior to the insertion of the cylindrical hollow needles into the connective holes of the ink cartridge, and FIG. 6(*b*) is a perspective view of the ink jet head and ink cartridge, after the insertion of the cylindrical hollow needles into the connective holes of the ink cartridge. FIG. 7(*a*) is a side view of the ink jet head and ink cartridge, prior to the insertion of the cylindrical hollow needles into the connective holes of the ink cartridge, and FIG. 7(*b*) is a side view of the ink jet head and ink cartridge, after the insertion of the cylindrical hollow needles into the connective holes of the ink cartridge. FIGS. 8(*a*) and 8(*b*) are enlargements of the B portions in FIGS. 7(*a*) and 7(*b*), respectively. FIG. 7(*b*) shows the cylindrical hollow needles and connective holes while the needles are inserted into the holes.

The method in this embodiment for supplying the ink jet head of an ink jet recording apparatus with ink is the so-called "pit-in" method as described above. However, the cylindrical hollow needles 36 of the ink jet head 33 are inserted into the connective holes 11 of the ink cartridge 10, or removed therefrom, by rotating the ink cartridge compartment 35 holding the ink cartridge 10 about the rotational axis 100 with the use of the unshown driving force source, instead of vertically moving the ink cartridge 10 in a manner to keep the surface of the ink cartridge having the openings of the connective holes 11, parallel to the counterpart of the ink jet head.

Figure 8:
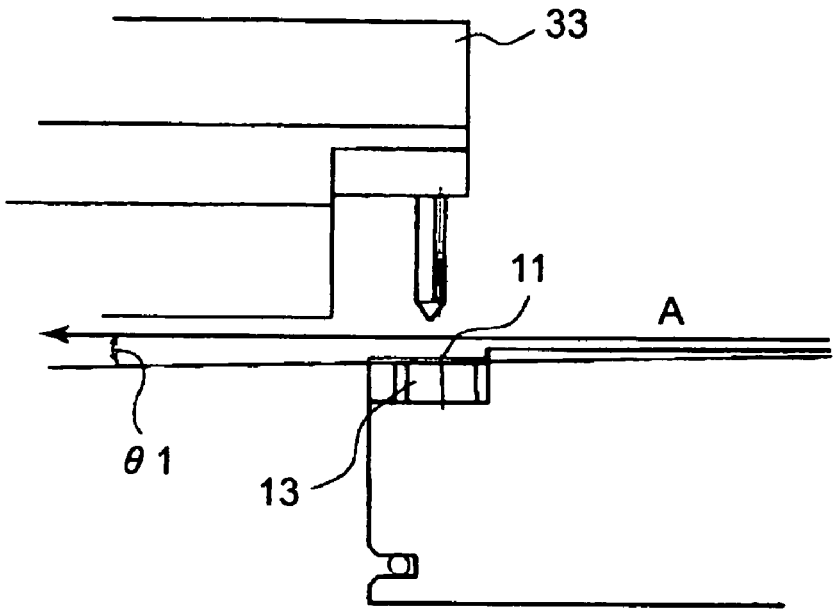
FIGS. 8(*a*) and 8(*b*) are enlargements of the connective portions of the combinations in FIGS. 7(*a*) and 7(*b*).
Figure 8:
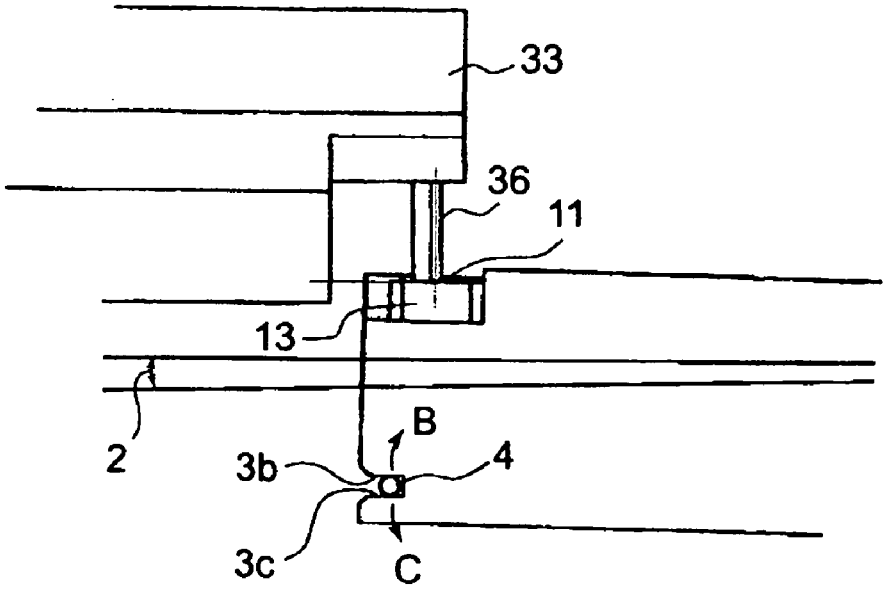

Referring to FIG. 8(*a*), immediately after the fitting of the rotational force transmitting portion 4 into the rotational force receiving portion 3, that is, immediately before the rotation of the ink cartridge 10 (ink cartridge compartment 35), the surface of the ink cartridge 10, at which the connective holes 11 opens, is angled at θ1 relative to the insertion direction of the ink cartridge 10.

After the fitting of the rotational force transmitting portion 4 into the rotational force receiving portion 3, the ink cartridge compartment 35 is rotated in the arrow B direction shown in FIG. 8(*b*). More specifically, as the first rotational force catching surface 3*b* of the rotational force receiving portion 3 catches the rotational force from the rotational force transmitting portion 4, the ink cartridge 10 (ink cartridge compartment 35) is upwardly rotated about the rotational axis 100. As the ink cartridge compartment 35 is rotated by the angle of θ2, which equals the above described angle θ1, the axial lines of the cylindrical hollow needles 36 come into contact with the plane of the surface of the ink cartridge 10 having the openings of the connective holes 11, at an angle of 90°. From this point in the rotation of the ink cartridge compartment 35 (ink cartridge 10), the cylindrical hollow needles 36 begins to be actually inserted into the connective holes 11. In this embodiment, as the ink cartridge compartment 35 is rotated by the angle of θ2, the connective holes 11 move by 5 mm.

Then, as the ink cartridge compartment 35 is further rotated, the cylindrical hollow needles 36 are put through the connective holes 11, one for one, making it ready for the ink jet to be supplied with ink. In this state, the ink in each ink pouch is supplied by a predetermined amount to the corresponding liquid chamber (unshown) in the ink jet head 33 by the negative pressure generated by the pump (unshown) connected to the ink jet head 33.

After the completion of the supply of ink, the ink cartridge compartment 35 is rotated in the direction indicated by an arrow mark C in FIG. 8(*b*). While the ink cartridge compartment 35 is rotated in this direction, the rotational force from the rotational force transmitting portion 4 is caught by the second rotational force catching surface 3*c* of the rotational force receiving portion 3. Therefore, the ink cartridge 10 (ink cartridge compartment 35) is downwardly rotated about the rotational axis 100.

As described above, in this embodiment, the cylindrical hollow needles 36 of the ink jet head 33 are inserted into the connective holes 11 of the ink cartridge 10, or removed therefrom, by rotating the ink cartridge 10 (ink cartridge compartment 35) by receiving the rotational force transmitted from the rotational force transmitting portion 4, by the rotational force receiving portion 3. Further, the ink cartridge 10 and ink cartridge compartment 35 are structured so that as the ink cartridge 10 is properly inserted into the ink cartridge compartment 35, the rotational force receiving portion 3 of the ink cartridge 10 is positioned on the diagonally opposite side of the ink cartridge compartment 35 from the rotational axis 100 of the ink cartridge compartment 35, and also, so that at the point in the rotation of the ink cartridge 10 when the cylindrical hollow needles 36 begins to be inserted into the connective hole 11, the axial line of each cylindrical hollow needles 36 becomes perpendicular to the surface of the ink cartridge 10 having the opening of each needles 36. With the provision of the above described structural arrangements, not only is the ink jet recording apparatus in this embodiment substantially smaller, in terms of the distance by which the ink container 10 (ink cartridge compartment 35) is driven, and the force necessary to drive the ink container 10 (ink cartridge compartment 35), than a recording apparatus in which an ink cartridge is moved, while keeping the surface of its connective portion parallel to the counterpart of the ink jet head, to insert the cylindrical hollow needles into the connective holes, or remove them out of the holes.

Embodiment 2

Next, another structural arrangement, in accordance with the present invention, for the rotational force receiving portion of the ink cartridge will be described.

Figure 9:
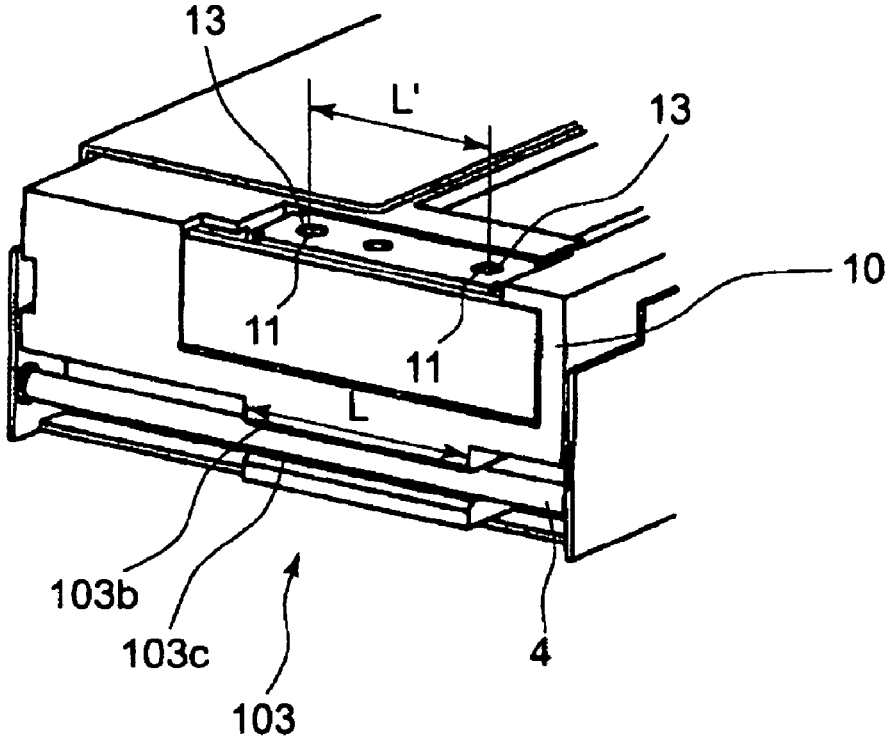
FIGS. 9(*a*) and 9(*b*) are enlarged perspective views of the rotational force receiving portion of the ink cartridge and its adjacencies, in the second embodiment of the present invention.
Figure 9:
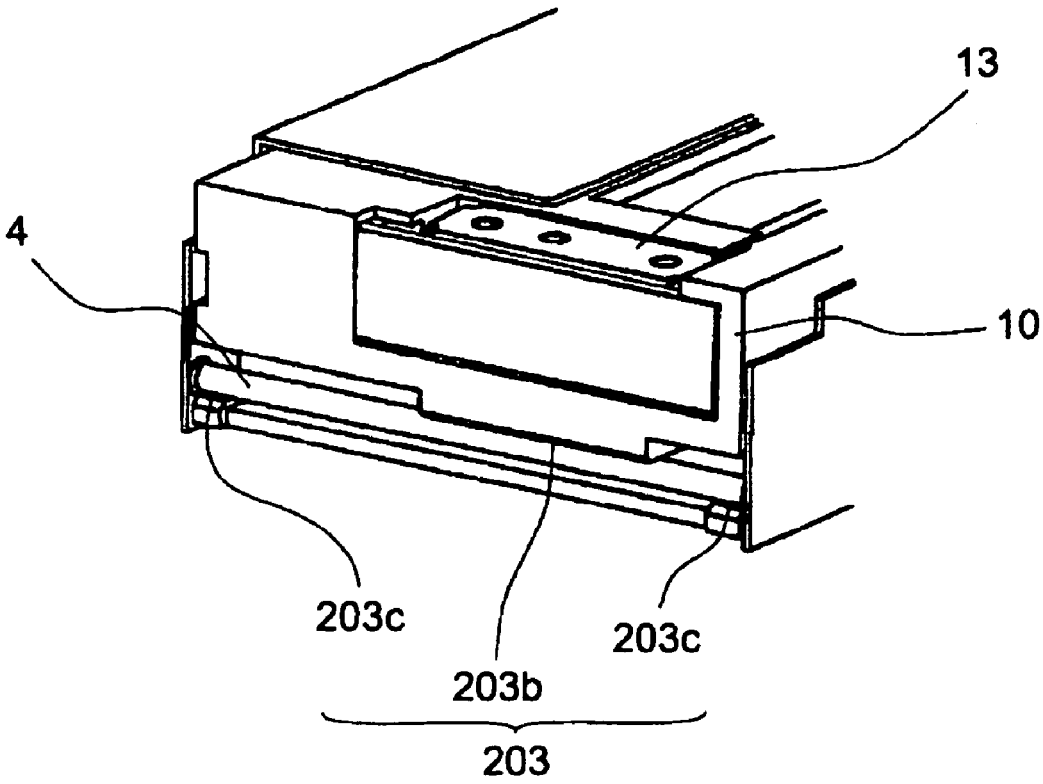

FIGS. 9(*a*) and 9(*b*) are enlarged perspective views of the rotational force receiving portion of the ink cartridge in this embodiment. The ink cartridge in this embodiment is basically not different in structure from the ink cartridge in the first embodiment, except for the positioning and shape of the rotational force receiving portion. Therefore, the portions of the ink cartridge in this embodiment similar in structure to those in the first embodiment will be not be described in detail, and only the portions different in structure from the counterparts in the first embodiment will be given referential numbers different from those given in the first embodiment.

Referring to FIG. 9(*a*), the rotational force receiving portion 103 of the ink cartridge in this embodiment is located directly below the connective portion 13. For the purpose of making the three sections of the connective portion 13 uniform in the amount of the rotational force they receive from the rotational force transmitting portion 4, the dimension L of the first rotational force catching portion 103*b* and the dimension L of the second rotational force catching portion 103*c*, in terms of the direction perpendicular to the lengthwise direction of the ink cartridge 10, are desired to be greater than the distance L' between the axial lines of the two outward connective holes 11.

In the case of the rotational force receiving portion 203 of the ink cartridge shown in FIG. 9(*b*), the first rotational force catching surface 203*b* is located directly below the connective portion 13 as is the rotational force receiving portion 103*b* shown in FIG. 9(*a*), and a pair of second rotational force catching surfaces 203*c* are located at the lengthwise ends of the rotational force receiving portion 203, one for one, as are the second rotational force catching surfaces 3*c* of the rotational force receiving portion 3 in the first embodiment.

Figure 10:
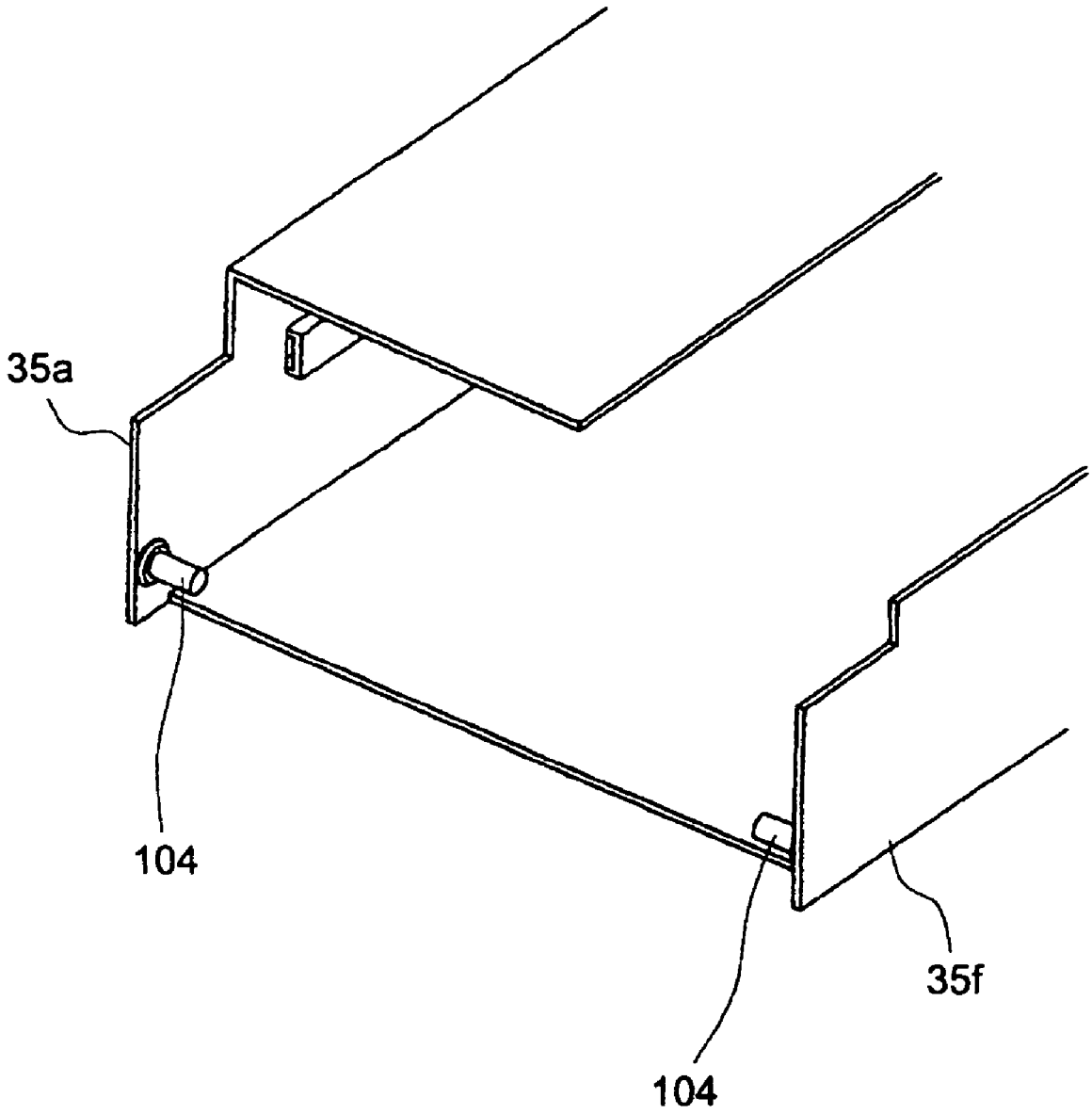
FIG. 10 is an enlarged perspective view of the portion of the ink cartridge compartment, provided with a rotational force transmitting portion made up of a pair of projections in the form of a claw.

Incidentally, if the rotational force transmitting portion is made up of a pair of cylindrical projections 104 in the form of a claw as shown in FIG. 10, unlike the rotational force transmitting portion in the first embodiment, which is in the form of a rod connecting the first and second side walls 35*a* and 35*f* of the ink cartridge compartment 35, the rotational force receiving portion 3 may be made up of a pair of grooves.

Further, the portion of the ink cartridge, by which the rotational force from the recording apparatus main assembly is received, does not need to be mechanical. For example, the rotational force transmitting portion and rotational force receiving portion may be held to each other by adhesion with the use of two-sided adhesive tape, for example, or magnetically held to each other with the use of a magnet.

Embodiment 3

Next, the ink cartridge in this embodiment, which is different in the structure of the ink cartridge positioning portion from the ink cartridges in the preceding embodiments, will be described.

In terms of basic structure, the ink cartridge in this embodiment is no different from the ink cartridge in the first embodiment, except for the positioning and shape of the ink cartridge positioning portion. Thus, the portions of the ink cartridge in this embodiment, which are the same in structure as the counterparts in the first embodiment will be not be described in detail, and only the portions of the ink cartridge, which are different in positioning and shape will be given referential symbols different from those in the first embodiment.

Figure 11:
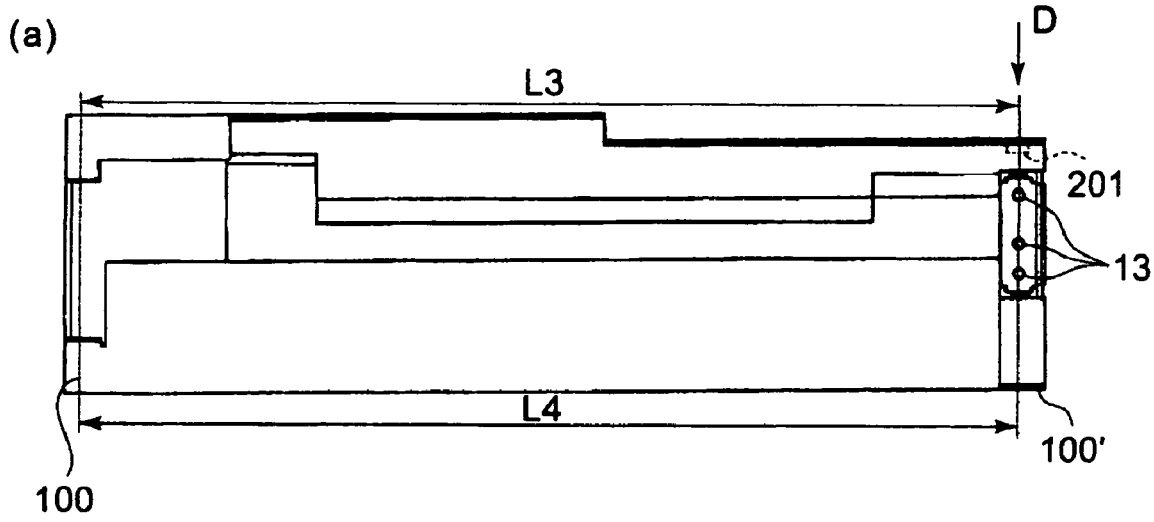
FIGS. 11(*a*) and 11(*b*) are top plan view and perspective views, respectively, of the ink cartridge, in the third embodiment of the present invention, the cartridge positioning recess of which is positioned so that the distance from the rotational axis of the ink cartridge compartment to the recess becomes equal to the distance from the rotational axis to the referential surface.
Figure 11:
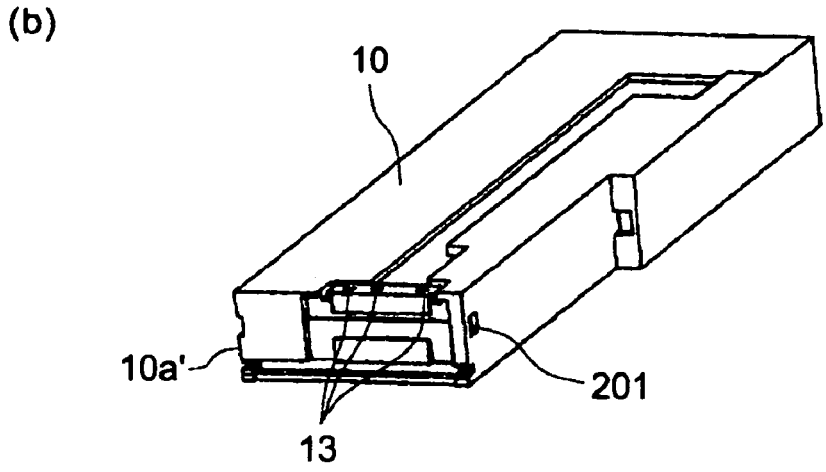

The recess 201 of the ink cartridge shown in FIGS. 11(*a*) and 11(*b*), into which the ink cartridge positioning means of the apparatus main assembly side latches, is located a distance of L3 away from the rotational axis 100 of the ink cartridge compartment 35. This distance L3 is equal to the distance L4 from the rotational axis 100 to the first referential area 10*a*' of the first side wall 10*a* of the ink cartridge 10. With the recess 201 positioned at the above described location, the force to which the recess 201 is subjected as the ink cartridge 10 is pushed in the arrow D direction when the ink cartridge positioning means of the apparatus main assembly side latches into the recess 201, applies to the first referential area 10*a*' in the direction perpendicular to the area 10*a*', minimizing the amount of the force which affects the distance from the rotational axis 100 to the connective portion 13.

Figure 12:
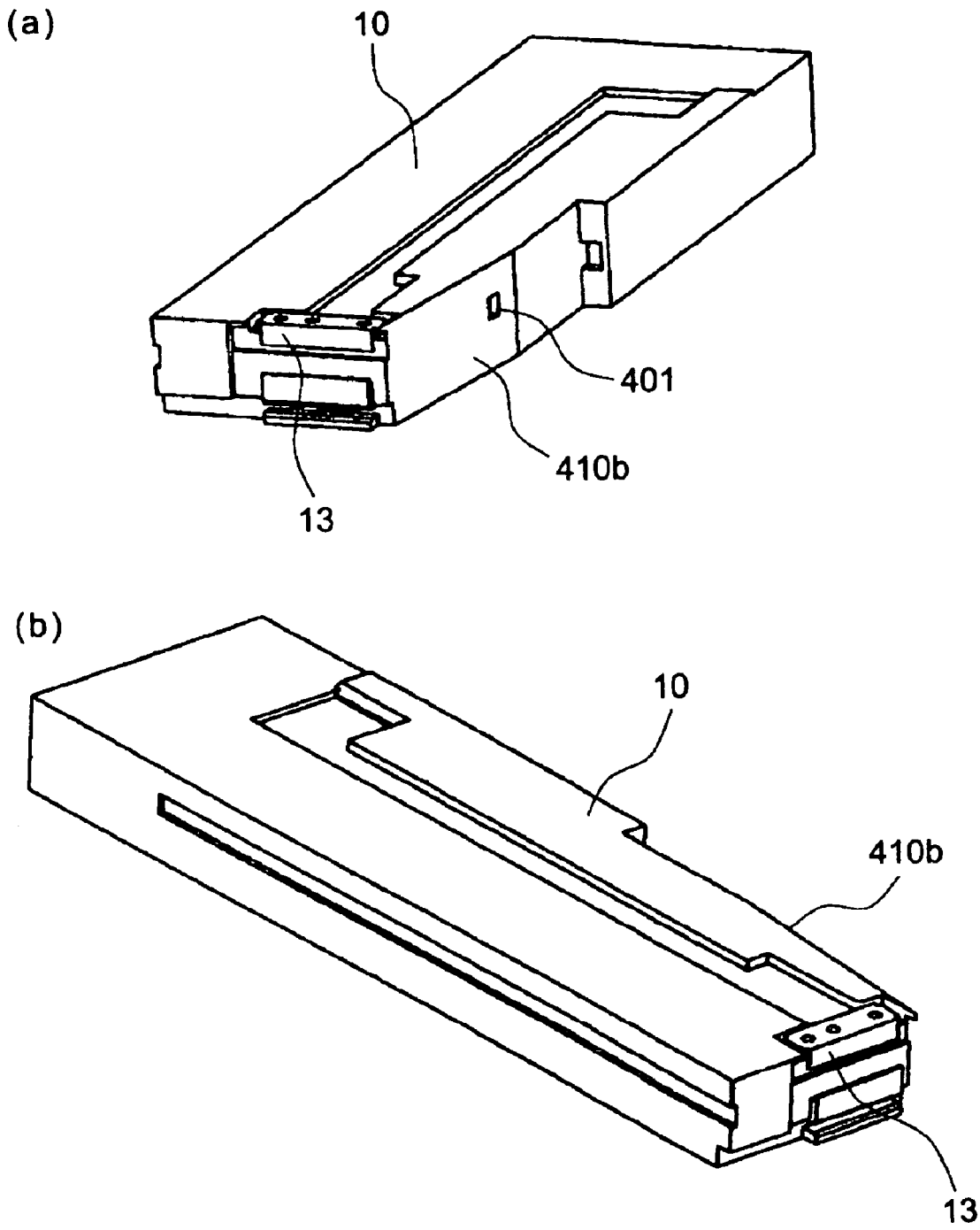
FIGS. 12(*a*) and 12(*b*) are perspective views, different in viewing angle, of the ink cartridge, the cartridge positioning recess of which is a part of the diagonal wall of the ink cartridge.

Further, referring to FIGS. 12(*a*) and 12(*b*), the lengthwise end of the ink cartridge 10 having the connective portion 13 may be narrowed to make diagonal the portion 410*b* of the second side wall 410 of the ink cartridge 10, having the recess 401, in order to make it easier to insert the ink cartridge 10 into the ink cartridge compartment 35.

Incidentally, the numerical values, materials, etc., mentioned in the above descriptions of the preferred embodiments of the present invention are not intended to limit the scope of the present invention.

While the invention has been described with reference to the structures disclosed herein, it is not confined to the details set forth, and this application is intended to cover such modifications or changes as may come within the purposes of the improvements or the scope of the following claims.

INDUSTRIAL APPLICABILITY

As described above, according to the present invention, the connection between an ink cartridge and a recording head is made by the rotation of the ink cartridge. Therefore, not only is the ink cartridge in accordance with the present invention substantially smaller in the distance it must be moved to be connected to the recording head, but also, in the amount of the force necessary to move the ink cartridge, being therefore smaller in the amount of electrical power used for supplying the ink jet head with ink, compared to an ink cartridge employed by a recording apparatus in which the connection is made by vertically moving an ink cartridge while keeping the connective portion of the ink cartridge parallel to the counterpart of the ink jet head. Thus, the present invention makes it possible to provide a small and light recording apparatus which can be continuously used for a long time.

The invention claimed is:

1. An ink cartridge which is detachably mountable to an ink cartridge mounting portion of an ink jet recording apparatus having an ink jet head, wherein the ink cartridge mounting portion defines a rotational center adjacent one end portion thereof and is provided with an operation mechanism for causing a rotation of the ink cartridge about the rotational center, wherein the ink cartridge is brought into fluid communication with the ink jet head by the rotation and is kept in fluid communication when ink is to be supplied to the ink jet head, and is brought out of fluid communication with the ink jet head by the rotation and is kept out of fluid communication otherwise, wherein the ink cartridge comprises:

a casing having a substantially rectangular parallelopiped shape including a first end portion;

a force receiving portion, provided at the first end portion of the ink cartridge, for receiving a force from the operation mechanism of the ink cartridge mounting portion; and a joint portion for supplying the ink, wherein the joint portion is connectable with a connecting portion of said ink jet recording apparatus which is in fluid communication with the ink jet head, wherein the joint portion is provided at the first end portion of the ink cartridge having the force receiving portion.

2. An ink cartridge according to claim 1, wherein the force receiving portion includes a first force receiving surface for receiving an upward force against gravity to bring the joint portion into fluid communication with the ink jet head and a second force receiving surface for receiving a downward force to bring the joint portion out of fluid communication with the ink jet head.

3. An ink jet recording apparatus comprising:

an ink jet head;

an ink cartridge mounting portion having an end portion and an operation mechanism;

an ink cartridge detachably mountable to the ink cartridge mounting portion, wherein the ink cartridge mounting portion defines a rotational center adjacent the end portion thereof and wherein the operation mechanism of the ink cartridge mounting portion causes rotation of the ink cartridge about the rotational center;

wherein the ink cartridge is brought into fluid communication with the ink jet head by the rotation and is kept in fluid communication when ink is to be supplied to the ink jet head, and is brought out of fluid communication with the ink jet head by the rotation and is kept out of fluid communication otherwise;

wherein the ink cartridge comprises:

a casing having a substantially rectangular parallelopiped shape including a first end portion;

a force receiving portion, provided at the first end portion of the ink cartridge, for receiving a force from the operation mechanism of the ink cartridge mounting portion; and a joint portion for supplying the ink, wherein the joint portion is connectable with a connecting portion of said ink jet recording apparatus which is in fluid communication with the ink jet head, wherein the joint portion is provided at the first end portion of the ink cartridge having the force receiving portion.

* * * * *